United States Patent [19]

Frankhouse

[11] Patent Number: 4,634,031

[45] Date of Patent: Jan. 6, 1987

[54] ARTICLE CARRIER

[76] Inventor: Florence D. Frankhouse, 2211-B E. Winston Rd., Anaheim, Calif. 92806

[21] Appl. No.: 741,450

[22] Filed: Jun. 5, 1985

[51] Int. Cl.[4] ..... A45C 13/30

[52] U.S. Cl. ..... 224/205; 224/203

[58] Field of Search ..... 224/203, 202, 151, 257, 224/258, 205, 253

[56] References Cited

U.S. PATENT DOCUMENTS

| | | | |
|---|---|---|---|
| 1,110,694 | 9/1914 | Jennings | 224/203 |
| 2,732,111 | 1/1956 | Fogle | 224/203 |
| 3,158,300 | 11/1964 | Withee | 224/253 X |
| 3,537,628 | 11/1970 | Thompson | 224/205 |
| 3,931,917 | 1/1976 | Zellmer | 224/203 |
| 4,125,212 | 11/1978 | Courchesne | 224/205 X |

*Primary Examiner*—Stephen Marcus
*Assistant Examiner*—Robert M. Petrik
*Attorney, Agent, or Firm*—Harvey C. Nienow

[57] ABSTRACT

An article carrier to be worn over a person's shoulder and around his or her torso which comprises a plurality of individual pocket members which are provided with zippers whereby any desired number of such pocket members can be contiguously arranged so that the length or size of such carrier can be left to the person's choice.

13 Claims, 5 Drawing Figures

FIG. 1
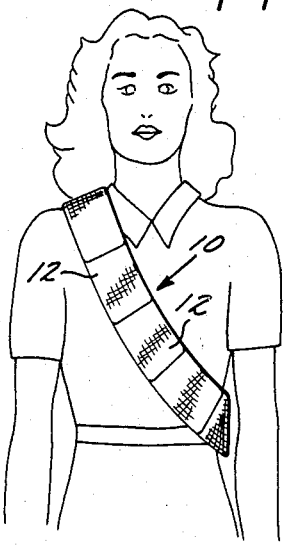
FIG. 2
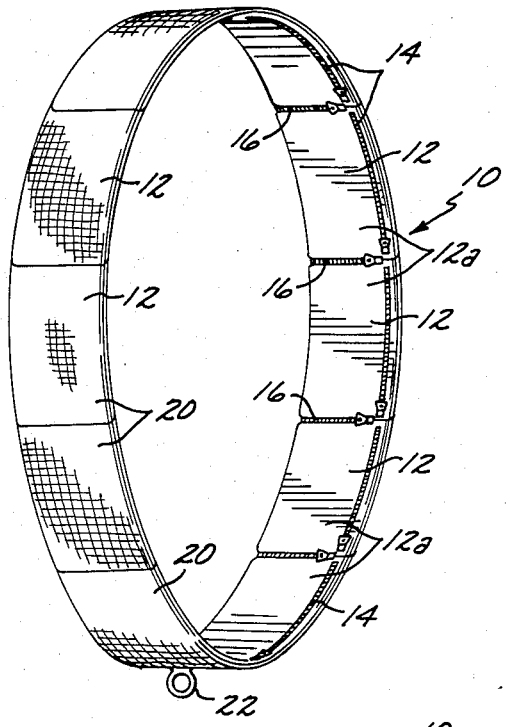
FIG. 5
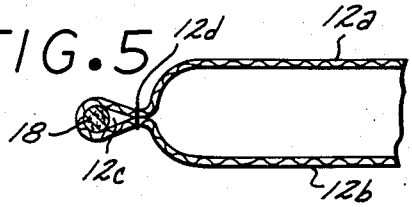
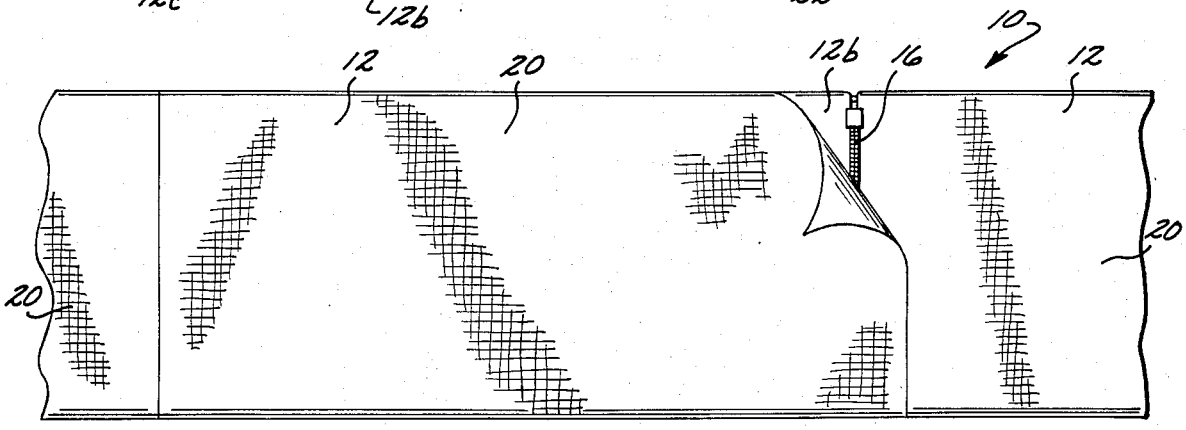
FIG. 3
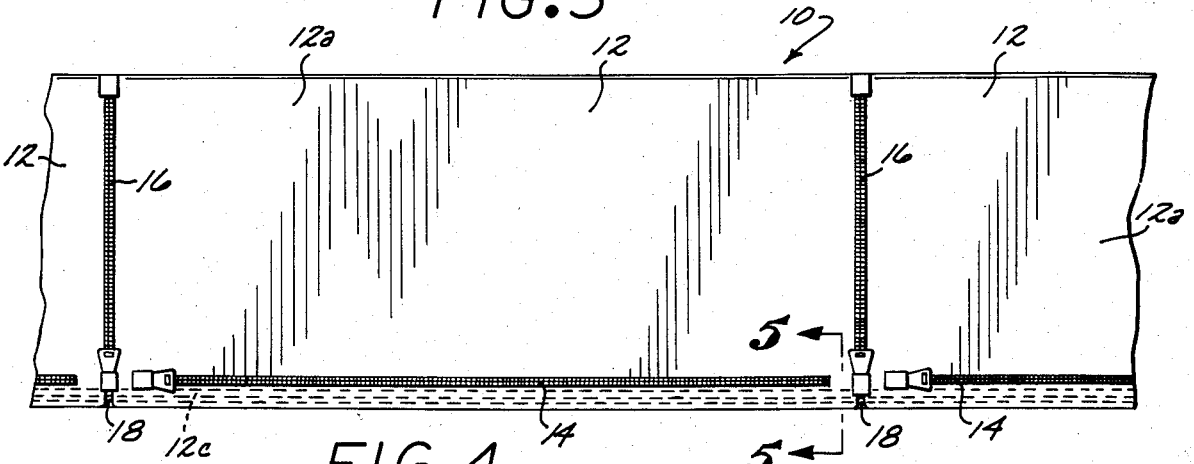
FIG. 4

ARTICLE CARRIER

The present invention relates generally to article carriers such as purses and the like, but more particularly to such carriers which are worn over a person's shoulder and around his or her torso.

BACKGROUND OF THE INVENTION

As styles and social conditions change, people's clothing and accessories change accordingly such that people are better able to provide the most comfortable and secure lifestyle under the prevailing conditions. That is, as individual privileges and freedoms become more precarious, such as is evidenced by the increase in personal confrontations in society, as a whole, it is desirable to have clothing and accessories thereto such as to provide additional protection or security for one's valuables. Today, there is virtually a constant threat to one's personal valuables when walking the streets or socializing in certain locations, and therefore it is desirable to have a container or carrier wherein to carry valuables such as money, home and car keys, checkbooks, as well as personal grooming items such as combs, lipsticks and the like.

Although shoulder purses have hereto fore been available, virtually all of such valuables and personal items have been easily accessible to persons who would steal from or create bodily harm to individuals. Therefore, it is desirable to have a purse or other type of article carrier which is virtually attached to or mounted on a person's torso such that the purse or carrier cannot be easily torn away from the person. Also, it is desirable to have such an article carrier which can be varied in size, as desired, so that it can be worn easily and comfortably by persons of different height and overall size.

OBJECTS OF THE INVENTION

In view of the foregoing, it is an object of the present invention to provide an article carrier to be worn over the shoulder and about the torso of a person.

Another object of the present invention is to provide an article carrier as characterized above which is formed of a plurality of individual pocket members which are connected together to form an endless carrier, there being attachment means for this purpose.

Another object of the present invention is to provide an article carrier as characterized above wherein the attachment means between individual pocket members are standardized to enable the various pocket members to be interchanged as desired.

An even still further object of the present invention is to provide an article carrier as characterized above wherein the individual pocket members can be formed of substantially any desired flexible sheet material such as plastic, cloth, leather and the like.

Another even still further object of the present invention is to provide an article carrier as characterized above wherein each individual pocket member is provided with closure means such that the wearer can quickly and easily remove articles from within such pocket member.

Another even still further object of the present invention is to provide an article carrier as characterized above which is simple and inexpensive to manufacture and which is rugged and dependable in operation.

BRIEF DESCRIPTION OF THE DRAWINGS

The novel features which I consider characteristic of my invention are set forth with particularly in the appended claims. The invention itself, however, both as to its organization and mode of operation, together with additional objects and advantages thereof, will best be understood from the following description of specific embodiments when read in connection with the accompanying drawings in which:

FIG. 1 is a fragmentary elevational view of a person wearing an article carrier according to the present invention;

FIG. 2 is a perspective view of the article carrier shown in FIG. 1;

FIG. 3 is a fragmentary elevational view of a portion of the article carrier of FIG. 2;

FIG. 4 is another fragmentary elevational view of such carrier; and

FIG. 5 is a fragmentary sectional view taken substantially along line 5—5 of FIG. 4 of the drawings.

Like reference characters indicate corresponding parts throughout the several views of the drawings.

DESCRIPTION OF THE PREFERRED EMBODIMENT

Referring to FIG. 1 of the drawings, there is shown therein an article carrier 10, according to the present invention, being worn by an individual. The carrier 10 is comprised of individual pocket members or compartments 12 which are connected together in contiguous fashion to provide the endless carrier 10 shown in FIG. 2 of the drawings.

Each pocket member 12 is made up of two pieces of identically-shaped flat sheet material which are firmly secured together along their peripheral edges to provide a pocket wherein articles such as checkbook, lipsticks, money and the like can be stored. In this regard, it is contemplated that one or both of such side members **12*a* and 12*b*** of each pocket may be formed with pleats or other appropriate means for enabling such pockets to expand to accommodate bulky articles.

Affording access to the interior or pocket of each pocket member 12 is closure means such as zipper 14. It is contemplated that the article carrier 10 can be such that the zipper 14 is located against the wearer's body or torso to enable only the wearer to have easy or ready access to the interior of such individual pocket members. Thus, as the zipper 14 is opened and closed, the wearer has access to articles within the corresponding pocket member.

Immediately adjacent the zipper 14, and extending the entire length of the corresponding pocket member 12, the side members **12*a* and 12*b* are joined together to provide a continuous opening or passageway 12*c*. To accomplish this, one or the other of such side members 12*a* and 12*b* is folded, as shown in FIG. 5, and fastening means such as a series of strong stitches or staples 12*d* is provided to form such passageway 12*c***.

The pocket members 12 are each provided with zipper means 16 along opposite edges thereof. That is, the opposite ends or edges of each pocket member 12 are relatively straight and uninterrupted so as to accommodate half of the zipper means 16, as shown most particularly in FIGS. 2 and 4 of the drawings. In this regard, one-half of the zipper means 16 is attached to one edge of each pocket member 12, and the other half of such zipper means is attached to the opposite edge thereof.

Thus, as will be readily apparent to those persons skilled in the art, the various zipper means 16 can be used to connect together the individual pocket members 12 so as to form the endless chain or loop of pocket members to provide the article carrier 10.

Once the article carrier is formed as the endless chain shown in FIG. 2, a cord 18 formed of nylon or the like is threaded through the then contiguously arranged openings or passageways 12*c* for purposes of security. After all of such pocket members 12 are so tied together by the cord 18, the opposite ends of such cord are firmly secured together by any appropriate means such as by tying a strong knot therein.

It is contemplated that the flexible interior sidewall 12*a* of each member 12 be formed of opaque material such as to enable the wearer of the article carrier to see through such sidewall into the pocket thereof. Thus, although the sidewall 12*a* would not be totally transparent, it would afford some "see through" qualities to enable the wearer to better locate articles within the pockets of the article carrier. The exterior sidewall 12*b* may be formed of any appropriate material, and may be covered with a decorative panel, as shown at 20, to hide or cover sidewall 12*b* and zipper means 16 between the several pocket members 12. To make the resulting article carrier attractive, the panel 20 may be of leather, vinyl, fur or any other appropriate material which is pleasing in appearance and which compliments other articles of clothing worn by the wearer of the subject article carrier 10. In this regard, it is contemplated that the panel 20 is provided with a mastic or bonding material on one surface thereof such that the panels 20 can be readily removed and other decorative panels substituted therefor, as desired.

Article carrier 10, it is contemplated, can be virtually any length, to accommodate the physical size of the wearer. That is, for smaller persons, fewer pocket members 12 would be necessary to make an endless chain of pocket members to provide a well-fitting article carrier 10. On the other hand, larger persons would require a greater number of pocket members to provide the desired comfort and appearance.

It is further contemplated that one of the pocket members 12 would be provided with a loop 22, as shown in FIG. 2 of the drawings, to enable the wearer to carry certain articles exteriorly of the various pocket members. In this regard, it is contemplated that portable telephone units may be commonplace within the near future, and it might be desirable for individuals to carry such a unit for ready and easy access. Thus, with the subject article carrier, it would be a simple matter for the wearer to carry such telephone unit from the loop 22. Further, however, such loop 22 is not limited to carrying telephone units, but rather can be used for virtually any type of article which the wearer prefers to carry externally of the article carrier.

It is thus seen that the present invention provides a strong, adaptable and secure article carrier to be worn on a person's body to carry substantially any type of item or article desired. It is secure in its position on the wearer's body, and is further secured by means of a cord which prevents the entire endless chain from being easily broken or torn from the wearer's body. It is also seen that the present invention provides the required flexibility for enabling the wearer to virtually design his or her own article carrier with respect to the length or size thereof, and with respect to the appearance thereof.

Although I have shown and described certain specific embodiments of my invention, I am well aware that many modifications thereof are possible. The invention, therefore, is not to be restricted except insofar as is necessitated by the prior art and by the spirit of the appended claims.

I claim:

1. An article carrier to be worn over the shoulder and around the torso of the wearer, comprising:

(a) a plurality of interconnected pocket members, each of said pocket members comprised of an inner and an outer generally rectangular panel and said panels disposed in contiguous overlying relation and being secured together along the peripheral edges thereof for providing a pocket therebetween;

(b) zipper means extend along two opposite lateral side edges of each of said pocket members;

(c) a zipper closure element secures together the zipper means of adjacent side edges of adjacent pocket members for interconnecting said pocket members and said interconnected pocket members arranged in a continuous endless looped chain;

(d) a zipper assembly extends generally transverse to and between the zipper means of each pocket member and is closely adjacent a longitudinal edge thereof for providing access to the associated pockets;

(e) a passageway extends along each of said pocket members adjacent the associated zipper assembly and the passageways of adjacent pocket members are aligned;

(f) cord means extend through each of said passageways for preventing said pocket members from being separated from said chain; and, (g) means associated with each of said outer panels for preventing viewing therethrough into the associated pocket.

2. The article carrier of claim 1, wherein:

(a) said zipper assembly extends along each of said inner panels.

3. The article carrier of claim 1, wherein:

(a) each of said panels comprised of a material permitting viewing therethrough.

4. The article carrier of claim 3, wherein:

(a) said means for preventing viewing including an opaque sheet secured to and covering said outer panels.

5. The article carrier of claim 4, wherein:

(a) adhesive means securing said sheet to said outer panels.

6. The article carrier of claim 1, wherein:

(a) said cord means having a pair of remote secured together ends.

7. The article carrier of claim 6, wherein:

(a) said cord means comprised of nylon.

8. An article carrier to be worn around the torso, comprising:

(a) a plurality of pocket members, each of said pocket members comprised of an inner and an outer generally rectangular panel and said panels disposed in corresponding overlying relation and secured together along the peripheral edges thereof for providing a pocket therebetween;

(b) each of said panels comprised of a material permitting viewing therethrough into the associated pocket;

(c) zipper means extend along two opposite lateral side edges of each of said pocket members;

(d) a zipper closure element secures together the zipper means of adjacent side edges of adjacent pocket members for interconnecting said pocket members and said interconnected pocket members arranged in a continuous endless looped chain;

(e) a zipper assembly extends generally transverse to and between the zipper means of each pocket member along the associated inner panel and is closely adjacent a longitudinal edge thereof for providing axis to the associated pocket;

(f) a passageway extends along each of said pocket members adjacent the associated zipper assembly and the passageways of adjacent pocket members are aligned;

(g) cord means extend through each of said passageways for preventing said pocket members from being separated from said chain; and, (h) means associated with each of said outer panels for preventing viewing therethrough into the associated pocket.

9. The article carrier of claim 8, wherein:

(a) said means for preventing viewing including an opaque sheet secured to and covering each of said outer panels.

10. The article carrier of claim 9, wherein:

(a) said sheet comprised of a material selected from the group leather, fur and vinyl.

11. The article carrier of claim 9, wherein:

(a) adhesive means securing said sheet to said outer panels.

12. The article carrier of claim 8, wherein:

(a) said cord means having a pair of secured together ends.

13. The article carrier of claim 12, wherein:

(a) said cord means comprised of nylon.

* * * * *